US010704785B2

(12) United States Patent
Ries et al.

(10) Patent No.: US 10,704,785 B2
(45) Date of Patent: Jul. 7, 2020

(54) METHOD AND DEVICE FOR FLAME SIGNAL DETECTION

(71) Applicant: Viessmann Werke GmbH & Co. KG, Allendorf (DE)

(72) Inventors: Martin Ries, Frankenberg (DE); Arno Clemens, Allendorf (DE); Richard Pfüller, Dillenburg (DE); Sebastian Hack, Wetter (DE)

(73) Assignee: Viessmann Werke GmbH & Co. KG, Allendorf (DE)

( * ) Notice: Subject to any disclaimer, the term of this patent is extended or adjusted under 35 U.S.C. 154(b) by 170 days.

(21) Appl. No.: 15/775,383

(22) PCT Filed: Oct. 26, 2016

(86) PCT No.: PCT/EP2016/075733
§ 371 (c)(1),
(2) Date: May 10, 2018

(87) PCT Pub. No.: WO2017/080820
PCT Pub. Date: May 18, 2017

(65) Prior Publication Data

US 2018/0372316 A1 Dec. 27, 2018

(30) Foreign Application Priority Data

Nov. 11, 2015 (DE) ..... 10 2015 222 263

(51) Int. Cl.
*F23N 5/12* (2006.01)
*F23N 1/02* (2006.01)

(52) U.S. Cl.
CPC ..... *F23N 5/123* (2013.01); *F23N 1/022* (2013.01); *F23D 2208/10* (2013.01);
(Continued)

(58) Field of Classification Search
CPC ..... F23N 5/123
(Continued)

(56) References Cited

U.S. PATENT DOCUMENTS 3,943,386 A * 3/1976 Simeau ..... F23N 5/123 327/512
4,220,857 A * 9/1980 Bright ..... F23N 5/082 250/339.15

(Continued)

FOREIGN PATENT DOCUMENTS

DE 2430328 A1 2/1975
DE 19947181 A1 12/2001

(Continued)

OTHER PUBLICATIONS

International Search Report dated Jan. 31, 2017 for PCT App. Ser. No. PCT/EP2016/075733.
Office Action dated Sep. 9, 2016 for corresponding DE App. Ser. No. 10 2015 222 263.2 with partial translation attached.

*Primary Examiner* — Avinash A Savani
(74) *Attorney, Agent, or Firm* — Henricks Slavin LLP

(57) ABSTRACT

The invention proposes a method for the flame signal detection by means of an ionization electrode (15) protruding into a combustion zone of a burner, comprising the steps: detecting a first signal, which is dependent on an ionization current flowing off the ionization electrode (15), generating a second signal which has a predetermined periodic course, generating a third signal by adding the first signal and the second signal, comparing the third signal with a first threshold value and generating a fourth signal on the basis of the comparison of the third signal with the first threshold value, comparing the third signal with a second threshold value different from the first threshold value and generating a fourth signal on the basis of the comparison of the third signal with the second threshold value, and determining an operating variable of the burner on the basis of at least one
(Continued)

of the fourth signal and the fifth signal. The invention additionally proposes a corresponding device for the flame signal detection.

13 Claims, 4 Drawing Sheets

(52) U.S. Cl.
CPC ..... *F23N 2223/10* (2020.01); *F23N 2223/16* (2020.01); *F23N 2223/42* (2020.01); *F23N 2229/10* (2020.01)

(58) Field of Classification Search
USPC ..... 431/24
See application file for complete search history.

(56) References Cited

U.S. PATENT DOCUMENTS

| | | | | | |
|---|---|---|---|---|---|
| 5,785,512 | A * | 7/1998 | Cormier | F23N 5/082 | 340/578 |
| 6,150,659 | A * | 11/2000 | Baliga | G01J 1/1626 | 250/339.15 |
| 2009/0248272 | A1 * | 10/2009 | Smith | F02D 41/2409 | 701/103 |

FOREIGN PATENT DOCUMENTS

| | | | |
|---|---|---|---|
| EP | 1154203 | A2 | 11/2001 |
| GB | 1096992 | A | 12/1967 |
| KR | 10-0778145 | | 11/2007 |

* cited by examiner

METHOD AND DEVICE FOR FLAME SIGNAL DETECTION

The invention relates to a method and a device for flame signal detection or flame resistance detection in a burner, in particular an oil or gas burner. In particular, the invention relates to a method and a device for adapting the signal detection of a combustion control system to the flame resistance range of a burner.

BACKGROUND OF THE INVENTION

The prior art knows methods in which an operating variable of a burner, e.g. the air ratio λ, is determined by measuring an ionization current flowing off the ionization electrode introduced into the combustion zone. Here, an alternating voltage is applied to the ionization electrode and a current which flows off the ionization electrode and is rectified due to the rectifying property of the flame is detected as the ionization current. Then, the measured ionization current is compared by means of a control circuit with a set point for the ionization current that corresponds to the adjusted set point of the air ratio, and the composition of the air-fuel mixture is appropriately corrected. Such a method is described in document DE 44 33 425 A1, for example. At the same time, it is known how to detect the presence of a flame in the combustion zone by means of an ionization current measurement or flame resistance measurement.

However, the problem of these previously known methods is that the control circuit has a fixed measurement resolution while the detected ionization current progresses in a non-linear fashion over its modulation range. Therefore, it is not possible to detect the ionization current or flame resistance at a plurality of operating points of the burner with the measurement resolution which is optimal for each operating point.

SUMMARY OF THE INVENTION

Therefore, an object of the invention is to provide methods and devices for the flame signal detection, which are free of the above described problems in the prior art. It is in particular an object of the invention to provide methods and devices for flame signal detection, by means of which the ionization current and/or flame resistance can be detected at operating points of the burner that are different from one another with the always optimum measurement resolution. A further object of the invention is to achieve a linearization of the ionization current signal over its entire modulation range.

In order to achieve this object, a method for flame signal detection and a device for flame signal detection comprising the features of the independent claims are proposed.

A first aspect of the invention proposes a method for flame signal detection by means of an ionization electrode protruding into a combustion zone of a burner. The method comprises the steps: detecting a first signal which is dependent on an ionization current flowing off the ionization electrode, generating a second signal which has a predetermined periodic course, generating a third signal by adding the first signal and the second signal, comparing the third signal with a first threshold value, comparing the third signal with a second threshold value differing from the first threshold value, generating a fourth signal on the basis of the comparison of the third signal with the first threshold value (i.e. generating the fourth signal by comparing the third signal with the first threshold value), generating a fifth signal on the basis of the comparison of the third signal with the second threshold value (i.e. generating the fifth signal by comparing the third signal with the second threshold value), and determining an operating variable of the burner on the basis of at least one of the fourth signal and fifth signal.

The first and second threshold values can here be preset in fixed fashion. The fourth and fifth signals can each be a signal (e.g. voltage signal) with a sequence of square pulses, in particular a pulse width-modulated (PWM) signal. The operating variable of the burner can be e.g. the ionization current, the flame resistance, the flame temperature, the air ratio or the burner output.

The above described method renders possible to generate signals by a suitable selection of the curve progression and of the first and second threshold values, each signal offering an optimum measurement resolution (susceptibility) for the evaluation of the ionization current signal for various operating points or operation ranges of the burner. For example, on the one hand, the presence of the flame can be detected in the start-up operation of the burner, i.e. when the flame resistance is high and the ionization current is low, can be detected with high reliability and time resolution. On the other hand, the flame resistance can simultaneously be determined with high precision during operation close to the optimum air ratio, i.e. when the flame resistance is low and the ionization current is large, and it is possible to correct the composition of the air-gas mixture on this basis with high precision. Therefore, the method according to the invention linearizes the ionization current signal via the modulation range of the burner and thus renders possible a safe and reliable control of the combustion process.

The predetermined course of the second signal preferably has a first section (curve section) with a first gradient value and a second section (curve section) with a second gradient value different from the first gradient value. The predetermined curve progression preferably has a rising edge and a descending edge, and the first section and the second section are arranged together in the rising edge or together in the descending edge. Here, the first section and the second section can both have the shape of a straight line, i.e. are straight sections. Alternatively, the first and second sections can be approximated straight lines which have averaged gradient values. The first and second sections can be adjacent to one another or follow one another in the time course of the curve progression.

The respectively desired measurement resolution (susceptibility) can be selected independently of one another for various operating states or operating ranges of the burner by a suitable selection of the different gradient values of the first and second sections.

In some embodiments of the invention, the first threshold value is selected in such a way that, for an ionization current occurring in a first operating state (or within a first operating range or at a first operating point) of the burner, the third signal crosses the first threshold value in each case at a first point in time within the period of the second signal (or within the period of the approximately periodic third signal), for which the second signal has a signal value which falls under the first section of the periodic course. In other words, the first threshold value is selected in such a way that the second signal at the first point in time has a signal value within the first curve section. Here, the first point in time is the point in time within the period of the second signal for which the value (signal value) of the third signal is equal to the first threshold value. If the first section is within the rising edge, the first point in time is the point in time at which the third signal exceeds the first threshold value. However, If the first section is disposed within the descending edge, the first point in time is the point in time at which the third signal drops below the first threshold value.

In some embodiments of the invention, the second threshold value is also selected in such a way that, for an ionization current occurring in a second operating state (or within a second operating range or at a second operating point) of the burner, the third signal crosses the second threshold value in each case at a second point in time within the period of the second signal (or within the period of the approximately periodic third signal), for which the second signal has a signal value that falls under the second section. In other words, the second threshold value is selected in such a way that the second signal at the second point in time has a signal value within the second curve section. Here, the second point in time is the point in time within the period of the second signal, for which the value (signal value) of the third signal is equal to the second threshold value. If the second section is within the rising edge, the second point in time is the point in time, at which the third signal exceeds the second threshold value. However, if the second section is disposed within the descending edge, the second point in time is the point in time, at which the third signal drops below the second threshold value.

Due to the differing selection of the first and second threshold values as well as the gradients of the first and second curve sections it is possible to achieve a measurement resolution which is optimal for the respective operating state of both the first operating state and the second operating state. For example, if a lower gradient is selected for the first curve section, minor changes in the ionization current will lead to major changes in the position of the first point in time, i.e. a high measurement resolution is achieved. Furthermore, if e.g. a major gradient is selected for the second curve section, larger changes in the ionization current will merely lead to minor changes in the position of the second point in time, and therefore changes in the ionization current can be detected and assessed over a wide value range.

The first gradient value is preferably lower than the second gradient value and the first operating state corresponds to a higher flame resistance than the second operating state.

In the event of a higher flame resistance, e.g. when the burner starts running, the ionization current is low and, in absolute terms, shows correspondingly minor changes. When a lower gradient is selected for the first curve section, even such relatively minor changes in the ionization current can be detected and a presence of the flame can be reliably detected. At the same time, the composition of the air-fuel mixture can be corrected with high accuracy. When the flame resistance is low, e.g. in the heating mode of the burner close to an optimum air ratio, the ionization current is correspondingly larger and accordingly includes changes over a wide value range. When a larger gradient is selected for the second curve section, changes in the ionization current itself can even be detected over a wide value range, such that the composition of the air-fuel mixture can be corrected with high accuracy here as well. As a result, a safe and stable control of the combustion system is achieved.

The value of the operating variable is preferably determined by a mathematical and/or logical linkage of the fourth signal and the fifth signal (or signals respectively derived therefrom). For example, the method can include the further steps: determining a first value of the operating variable of the burner on the basis of the fourth signal, determining a second value of the operating variable of the burner on the basis of the fifth signal, and determining a third value of the operating variable of the burner on the basis of at least one of the first value and the second value. Here, the third value can be obtained by mathematical and/or logical linkage of the first value and of the second value. For example, a decision can be made on the basis of the first value and the second value to output the first value as the third value or to output the second value as the third value or to output a weighted sum of the first value and of the second value as the third value. The weighting can here be based on an operating state derived from the first and/or second value.

On account of such a determination of the value of the operating variable of the burner it is possible to refer to the one signal of the fourth and fifth signals which provides the optimum measurement resolution for the current operating state or operating range of the burner.

A second aspect of the invention proposes a device for detecting flame signals by means of an ionization electrode protruding into a combustion zone of a burner. The device comprises means (e.g. a measuring device) for detecting a first signal that is dependent on an ionization current flowing off the ionization electrode, means (e.g. a signal generator) for generating a second signal which has a predetermined periodic progression, means (e.g. an adder) for generating a third signal by adding the first signal and the second signal, means (e.g. a first comparator) for comparing the third signal with a first threshold value and for generating a fourth signal on the basis of the comparison of the third signal with the first threshold value (i.e. for generating the fourth signal by comparing the third signal with the first threshold value), means (e.g. a second comparator) for comparing the third signal with a second threshold value that differs from the first threshold value and for generating a fifth signal on the basis of the comparison of the third signal with the second threshold value (i.e. for generating the fifth signal by comparing the third signal with the second threshold value), and means (e.g. an evaluation circuit) for determining an operating variable of the burner on the basis of at least one of the fourth signal and the fifth signal.

The first and second threshold values can here be preset in fixed fashion. Each of the fourth and fifth signals can be a signal (e.g. voltage signal) with a sequence of square pulses, in particular a PWM signal.

The predetermined progression of the second signal preferably has a first section (curve section) with a first gradient value and a second section (curve section) with a second gradient value differing from the first gradient value. The predetermined curve progression preferably has a rising edge and a descending edge, and the first section and the second section are arranged together in the rising edge or together in the descending edge. Here, the first section and the second section can both have the shape of a straight line, i.e. can be straight sections. Alternatively, the first and second sections can be approximated straight lines which have averaged gradient values. The first and second sections can be adjacent to one another or follow in the time course of the curve progression.

In some embodiments of the invention, the first threshold value is selected in such a way that, for an ionization current occurring in a first operating state (or within a first operating range or at a first operating point) of the burner, the third signal crosses the first threshold value in each case at a first point in time within the period of the second signal (or within the period of the approximately periodic third signal), for which the second signal has a signal value that falls under the first section of the periodic course. In other words, the first threshold value is selected in such a way that the second signal at the first point in time has a signal value within the first curve section. Here, the first point in time is the point in time within the period of the second signal, for which the value (signal value) of the third signal is equal to the first threshold value. If the first section is disposed within the rising edge, the first point in time is the point in time, at which the third signal exceeds the first threshold value. However, if the first section is disposed within the descending edge, the first point in time is the point in time, at which the third signal drops below the first threshold value.

In some embodiments of the invention, the second threshold value is also selected in such a way that, for an ionization current occurring in a second operating state (or within a second operating range or at a second operating point) of the burner, the third signal crosses the second threshold value in each case at a second point in time within the period of the second signal (or within the period of the approximately periodic third signal), for which the second signal has a signal value that falls under the second section. In other words, the second threshold value is selected in such a way that the second signal at the second point in time has a signal value within the second curve section. Here, the second point in time is the point in time within the period of the second signal, for which the value (signal value) of the third signal is equal to the second threshold value. If the second section is disposed within the rising edge, the second point in time is the point in time, at which the third signal exceeds the second threshold value. However, if the second section is disposed within the descending edge, the second point in time is the point in time, at which the third signal drops below the second threshold value.

The first gradient value is preferably lower than the second gradient value, and the first operating state corresponds to a higher flame resistance than the second operating state.

In some embodiments of the invention, the means for determining the operating variable of the burner are designed to determine the value of the operating variable by mathematical and/or logical linkage of the fourth signal and of the fifth signal (or of signals respectively derived therefrom). For example, the means for determining the operating variable of the burner can be designed to determine a first value of the operating variable of the burner on the basis of the fourth signal, to determine a second value of the operating variable of the burner on the basis of the fifth signal, and to determine a third value of the operating variable of the burner on the basis of at least one of the first value and the second value. Here, the third value can be obtained by mathematical and/or logical linkage of the first value and of the second value. For example, a decision can be made on the basis of the first value and the second value to output the first value as the third value or to output the second value as the third value or to output a weighted sum of the first value and of the second value as the third value. The weighting can here be based on an operating state derived from the first and/or second value.

BRIEF DESCRIPTION OF THE DRAWING

Further advantageous embodiments, to which the scope of the invention is, however, not limited, follow from the below description by means of the drawing. Identical elements are here labeled with identical reference signs in the figures, and a repetition of the description of already described elements is omitted, wherein in detail.

DETAILED DESCRIPTION OF THE INVENTION

Figure 1:
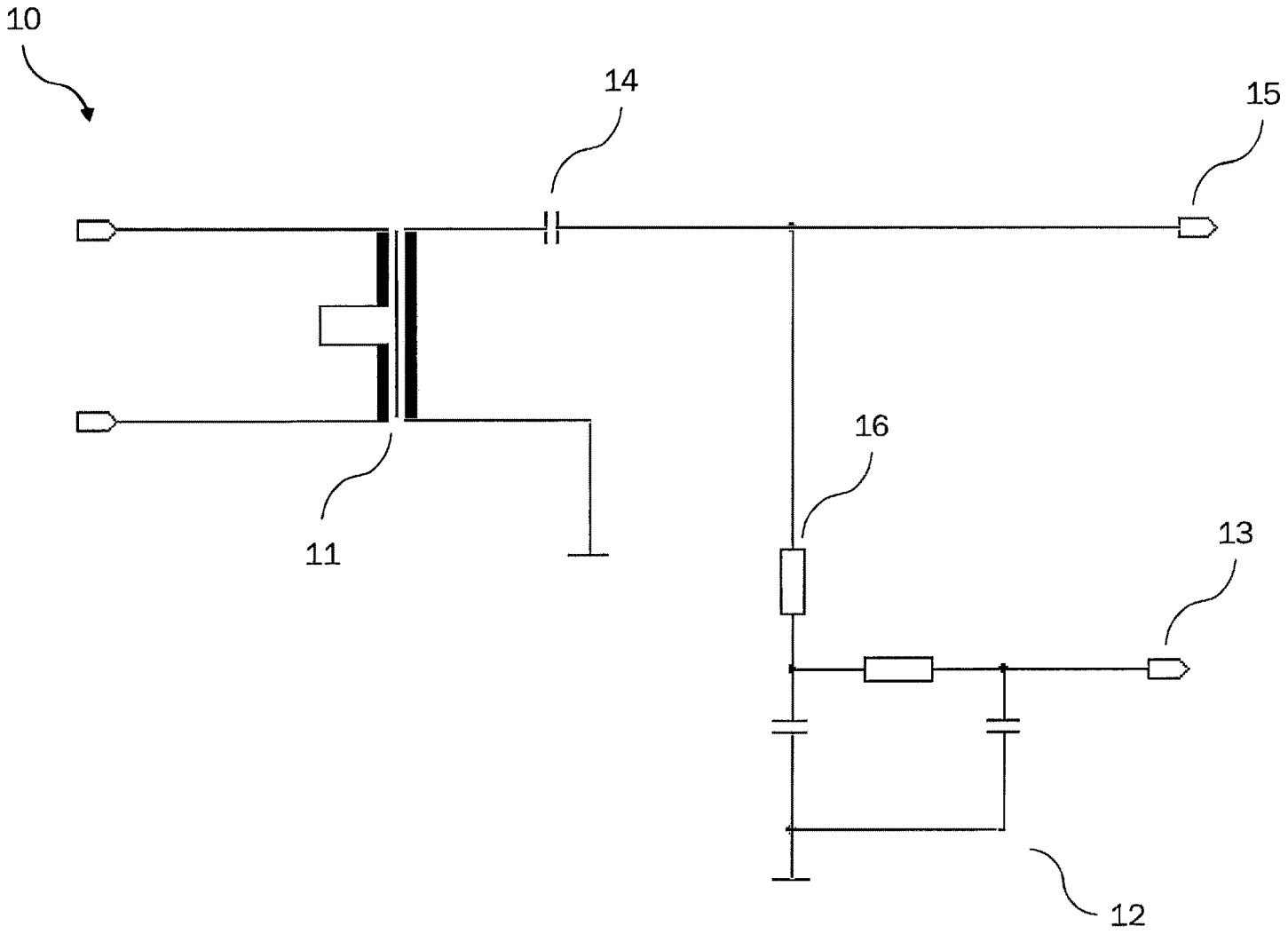
FIG. 1 shows an arrangement for measuring the ionization current flowing off an ionization electrode protruding into a flame.

FIG. 1 shows an arrangement 10 for measuring and/or detecting the ionization current flowing off an ionization electrode protruding into a flame, and/or a first signal that is dependent on the ionization current. A supplied supply voltage (e.g. power supply) is converted into an alternating voltage having a suitable amplitude by means of a transformer 11 and is applied to the ionization electrode 15 via a capacitor 14. Since the flame has a rectifying property, the capacitor 14 is charged with a voltage which is proportional to the ionization current. This leads to a displacement of the zero point of the alternating voltage. The resulting alternating voltage, i.e. a signal (voltage signal) dependent on the current flowing off the ionization electrode 15, is filtered through a low-pass filter 12, and the filtered DC voltage portion is outputted at an outlet 13 of the arrangement 10. This voltage is a negative voltage due to the polarity of the rectifying property of the flame. The arrangement 10 can also comprise suitable resistors 16. The first signal is e.g. the signal outputted at the outlet 13.

Figure 2:
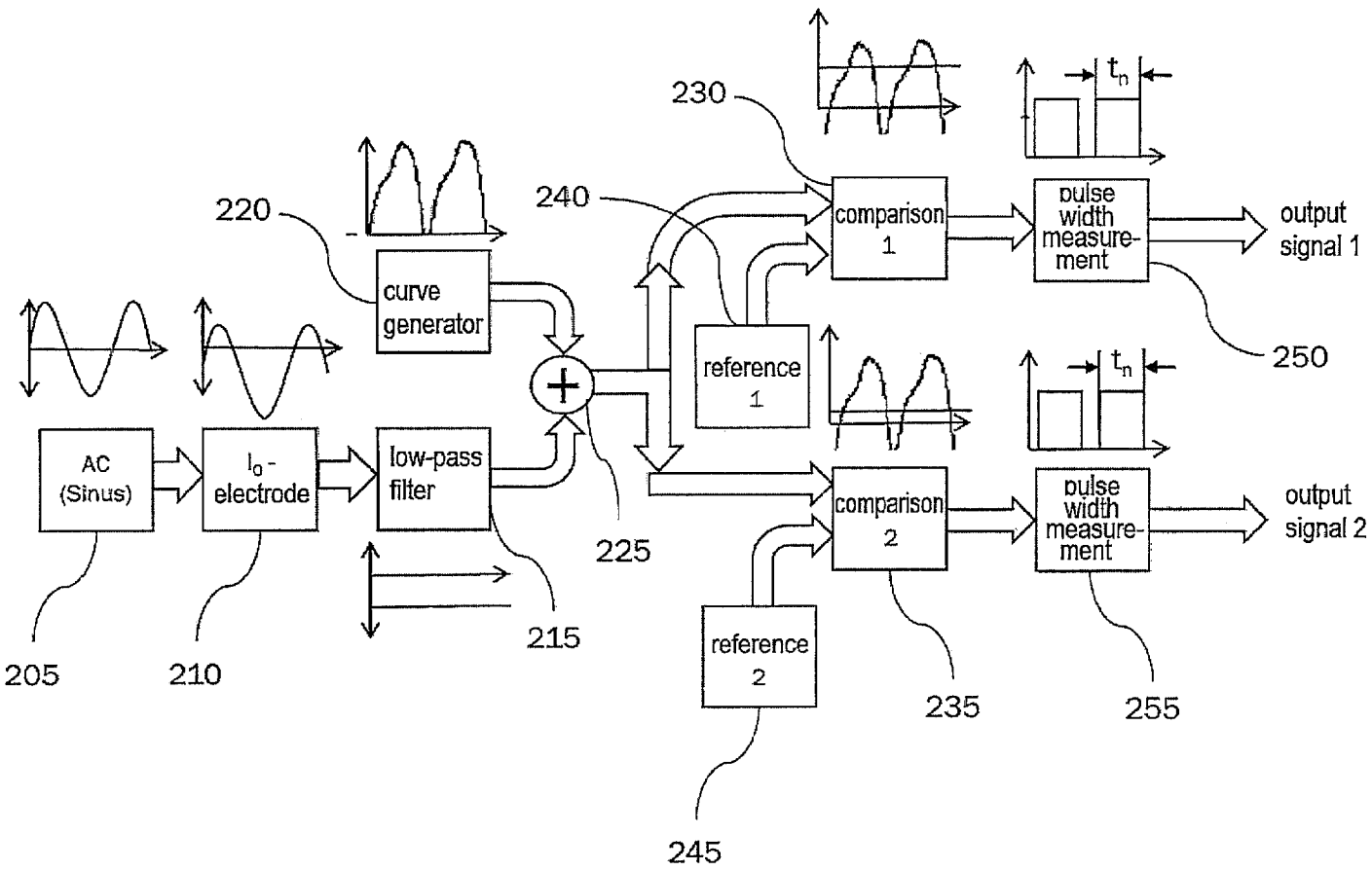
FIG. 2 shows an exemplary schematic diagram of an example of a method according to some embodiments of the invention.

FIG. 2 shows schematically a block diagram of an example of the method according to the invention. The individual blocks here correspond to method steps or corresponding devices and means which are designed to carry out the respective method steps.

In block 205, the supply voltage (e.g. power supply) is converted into an alternating voltage having a suitable amplitude, and in block 210, it is applied to the ionization electrode 15. The alternating voltage applied to the ionization electrode 15 and the resulting voltage signal picked up at the ionization electrode are shown by way of diagram above the blocks 205, 210. As a result of the current flowing off the ionization electrode 15, the original alternating voltage signal is given a negative offset.

In block 215, the resulting signal is filtered by means of a low-pass filter 12. As a result, a first signal which is dependent on an ionization current flowing off the ionization electrode is obtained. In other words, the negative offset given to the alternating voltage signal is isolated by the low-pass filter 12 and outputted as the first signal. An example of the time course of the first signal is shown in FIG. 2 below block 215.

When the above described steps are carried out, it is at the discretion of a person skilled in the art to appropriately modify individual or all steps as long as a signal dependent on the ionization current flowing off the ionization electrode is ultimately obtained, and the invention is not limited to the above described method for detecting such a signal.

In block 220, a second signal is generated which has a periodic course (curve progression), e.g. a voltage signal with periodic curve progression. Here, the periodic course is preset in fixed fashion in the operation of the burner but can basically be selected or adapted in accordance with the burner properties. The generation can be effected e.g. by a curve generator or signal generator (means for generating the second signal). Here, the second signal can be generated by means of suitable software and a digital-analog converter or by means of pulse width modulation and can be adapted to the respective burner properties. A burner-specific curve progression can be stored in advance in a memory. A schematic example of the curve progression is shown in FIG. 2 above block 220.

In each period of the second signal, the predetermined curve progression (i.e. the signal value as a function of time) has a first section with a first gradient value (change in the signal value per unit time or first time derivative of the curve progression) and a second section with a second gradient value, wherein the two gradient values are different from each other. In each period, the curve progression also has a rising edge and a descending edge. Here, the first section and the second section are preferably arranged in the same edge, i.e. both in the rising edge or both in the descending edge. Here, the two sections can be adjacent to each other. In order to ultimately obtain PWM signals with fixed frequency, the edge in which the two sections are not arranged can additionally be very steep or substantially perpendicular. In the simplest case, the two sections both have the shape of a straight line or an approximated straight line. In the case of an approximated straight line, the respective gradient value can be obtained by averaging gradient values.

Figure 4:
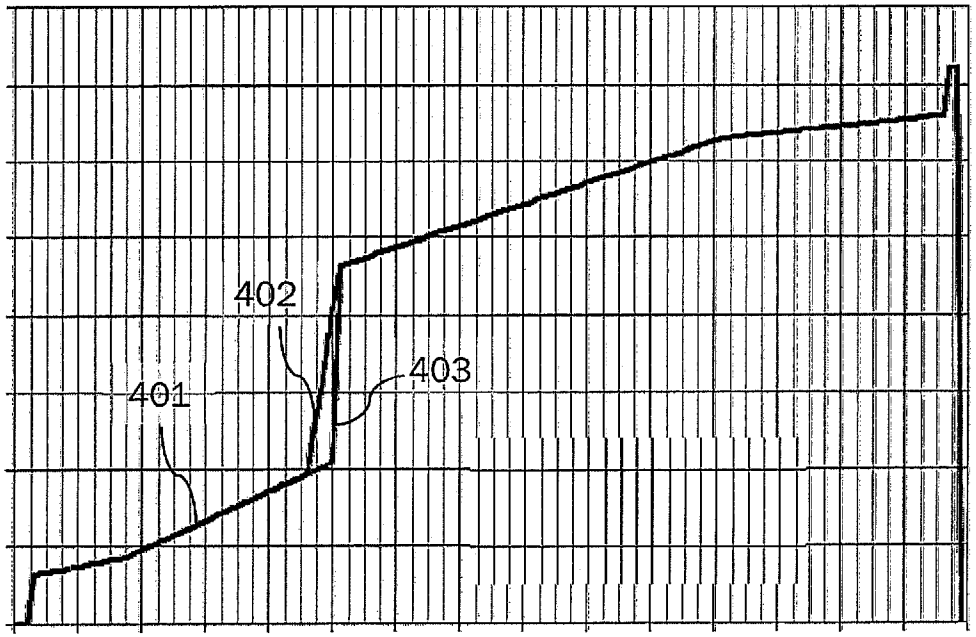
FIG. 4 shows an exemplary schematic diagram of the curve progression of the second signal over a period of the second signal.

Examples of two possible curve progressions of the second signal are shown in FIG. 4. The two curve progressions have a first section 401 of lower gradient value. The first of the two curve progressions additionally has a second section 402, and the second of the two curve progressions has a second section 403. In the two curve progressions, the gradient value of the second section 402, 403 is larger than that of the first section 401. In each case, the first section 401 and the second section 402, 403 are directly adjacent to each other or merge into each other. Below the first section 401 and/or above the second section 402, 403, the curve progression can have further sections. The descending edge of the curve progression extends substantially perpendicularly in the example of FIG. 4 to obtain PWM signals with fixed frequency in the below described blocks 230, 235.

In block 225, the first signal and the second signal are added together (mixed) to obtain a third signal. The addition or generation of the third signal can be carried out e.g. by an adder (means for generating the third signal). The weighting of the two signals is here determined by a mixing ratio or a mixing resistance. The susceptibility or measurement resolution of the entire system (i.e. equally for all operating ranges) can be determined by a suitable selection of the mixing ratio. A higher weighting of the first signal increases the susceptibility of the measurement and reduces the value range which is covered by the measurement. However, a higher weighting of the second signal reduces the susceptibility of the measurement and increases the value range which can be covered by the measurement. For a constant ionization current, the third signal is a periodic signal with a period which is equal to the period of the second signal and, apart from that, an approximately periodic signal.

In block 230, the resulting mixed voltage or, in general, the third signal, is compared with a first reference value (first threshold value), and a fourth signal (e.g. voltage signal) is generated on the basis of the comparison. The fourth signal is preferably a signal (e.g. voltage signal) which is formed by a sequence of square pulses, in particular by a PWM signal. In this case, a first level (e.g. the upper level) of the PWM signal is outputted if the signal value of the third signal is above the first threshold value, and the second level (e.g. the lower level) is outputted if the signal value of the third signal is below the first threshold value. The third signal can be compared with the first threshold value e.g. by means of a first comparator (means for generating the fourth signal). A schematic example of the time course of the fourth signal is shown in FIG. 2 above block 250.

The first reference value (threshold value) is generated in block 240 as a constant signal (e.g. voltage signal), e.g. by means of a controllable voltage source or a DA converter (means for generating the first threshold value). The controllable voltage source can be controlled e.g. by means of a PWM control signal.

In block 235, the mixed voltage or, in general, the third signal is compared with a second reference value (second threshold value), and a fifth signal (e.g. voltage signal) is generated on the basis of the comparison. The fifth signal is preferably a signal (e.g. voltage signal) which is formed by a sequence of square pulses, in particular by a PWM signal. In this case, a first level (e.g. the upper level) of the PWM signal is outputted if the signal value of the third signal is above the second threshold value, and the second level (e.g. the lower level) is outputted if the signal value of the third signal is below the second threshold value. The third signal can be compared with the second threshold value e.g. by means of a second comparator (means for generating the fifth signal). A schematic example for the time course of the fifth signal is shown in FIG. 2 above block 255.

The second reference value is generated in block 245 as a constant signal (e.g. voltage signal), e.g. by means of a controllable voltage source or a DA converter (means for generating the second threshold value). The controllable voltage source can be controlled e.g. by means of a PWM control signal.

When the curve progression of the second signal is predetermined, the first threshold value is preferably selected in such a way that, for an ionization current (or flame resistance) occurring in a first operating state (or within a first operating range or at a first operating point) of the burner, the third signal crosses the first threshold value in each case at a first point in time within the period of the second signal (or within the period of the approximately periodic third signal) for which the second signal has a signal value that falls under the first section of the periodic course. In other words, the first threshold value is selected in such a way that the second signal at the first point in time has a signal value within the first curve section. Here, the first point in time is the point in time within the period of the second signal, for which the value (signal value) of the third signal is equal to the first threshold value. If the first section is within the rising edge, the first point in time is the point in time, at which the third signal exceeds the first threshold value. However, if the first section is within the descending edge, the first point in time is the point in time, at which the third signal drops below the first threshold value.

For example, the first operating state of the burner can be the start-up operation in which the flame resistance is correspondingly large (e.g. about 70 to 100 MO). The high flame resistance leads to a comparatively low ionization current with, in absolute terms, minor changes per unit time. In this case, the gradient value for the first section can be selected to be low (or lower than the gradient value of the second section), and the first threshold value can furthermore be selected in such a way that in the point in time (first point in time), at which the third signal exceeds the first threshold value (if the first section is arranged in the rising edge of the second signal) or in the point in time, at which it again drops below the first threshold value (if the first section is arranged in the descending edge of the second signal), the signal value of the second signal is within the first section.

Due to the low gradient of the first section, minor changes of the ionization current or flame resistance (in absolute terms) now already result in a marked displacement of the first point in time, at which the third signal crosses the first threshold value. Therefore, it is also possible to detect such relatively minor changes of the ionization current and to reliably detect e.g. the flame. In addition, the composition of the air-fuel mixture can also be corrected with high accuracy.

Correspondingly, the second threshold value can be selected in such a way that, for an ionization current (or flame resistance) occurring in a second operating state (or within a second operating range or at a second operating point) of the burner, the third signal crosses the second threshold value in each case at a second point in time within the period of the second signal (or within the period of the approximately periodic third signal), for which the second signal has a signal value that falls under the second section. In other words, the second threshold value is selected in such a way that the second signal at the second point in time has a signal value within the second curve section. Here, the second point in time is the point in time within the period of the second signal, for which the value (signal value) of the third signal is equal to the second threshold value. If the second section is within the rising edge, the second point in time is the point in time, at which the third signal exceeds the second threshold value. However, if the second section is within the descending edge, the second point in time is the point in time, at which the third signal drops below the second threshold value.

For example, the second operating state of the burner can be the operation (e.g. heating mode) close to an optimum air ratio (e.g. $\lambda \approx 1.3$) where the flame resistance is correspondingly low (e.g. about 70 to 100 kΩ). The low flame resistance then leads to a comparatively large ionization current with, in absolute terms, major changes per unit time. In this case, the gradient value of the second section can be selected to be large (or larger than the gradient value of the first section), and the second threshold value can furthermore be selected in such a way that in the point in time (second point in time) at which the third signal exceeds the second threshold value (if the second section is arranged in the rising edge of the second signal) or in the point in time, at which it drops again below the second threshold value (if the second section is arranged in the descending edge of the second signal), the signal value of the second signal is within the second section.

Due to the large gradient of the second section, major changes (in absolute terms) in the ionization current or flame resistance now also result in a minor displacement of the second point in time, at which the third signal crosses the second threshold value. Therefore, relatively large changes can also be detected over a wide value range of the ionization current, and the composition of the air-fuel mixture can be corrected with high accuracy.

In summary, the position of the first and second operating ranges within which a detection of the ionization current or flame resistance with corresponding measurement resolution is desired, can be predetermined with given curve progression of the second signal by selecting the first and second reference voltages. Where necessary, an overlapping range of the operating ranges can be determined by suitably selecting the reference voltages. However, the respective measurement resolution is predetermined by selecting the first and second gradient values. Here, a larger gradient value signifies a lower measurement resolution (susceptibility), and a lower gradient value signifies a higher measurement resolution.

In other words, the suitable selection of the curve progression of the second signal can linearize the ionization signal course (or flame resistance signal course) of a burner over the entire modulation range. As a result, a safe and stable control of the combustion system or the combustion operation is possible. All in all, the method according to the invention offers five parameters (first threshold value, second threshold value, first gradient value, second gradient value, mixing ratio), via the selection of which an ionization signal course which is optimal for the combustion control can be achieved.

Figure 3:
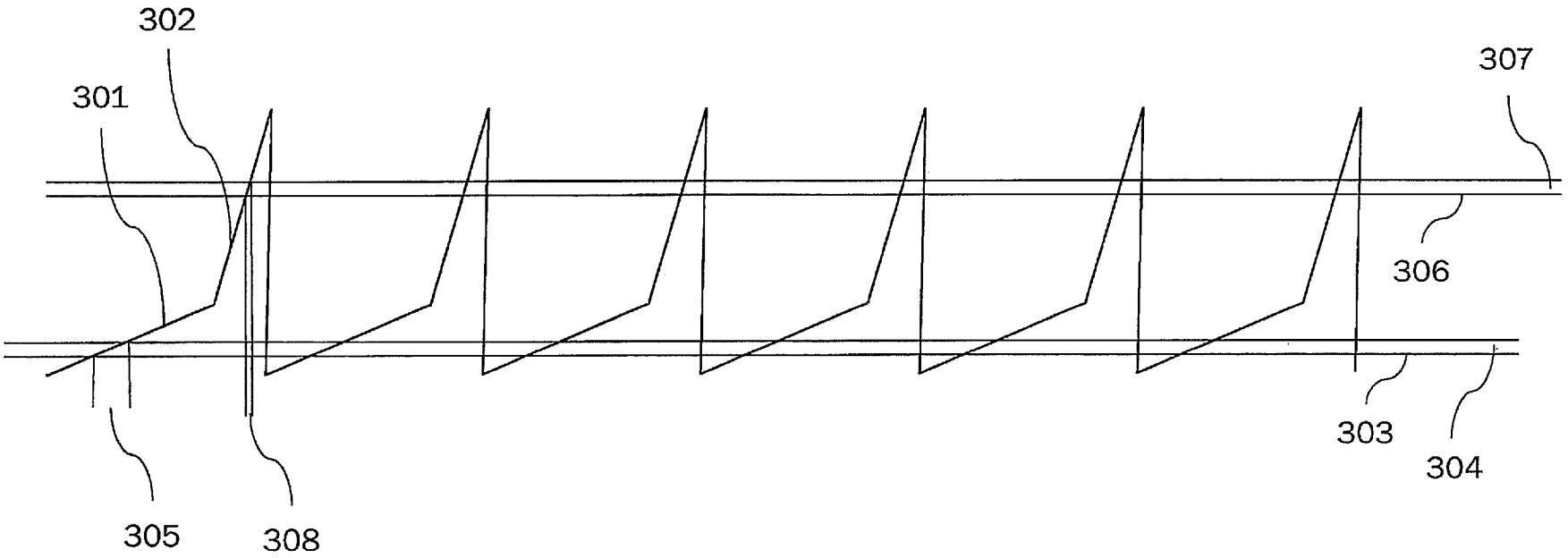
FIG. 3 shows, by way of example, a schematic diagram of an example of the time course of the third signal.

The correlation between measurement resolution (susceptibility), gradient values and threshold values is shown by way of example in FIG. 3, which as a first example comprises the operation in a first operating state and as a second example comprises the operation of the burner in a second operating state. The third signal shown in FIG. 3 is due to a displacement of the second signal to negative voltage values on account of the addition of the (negative) first signal. Correspondingly, the third signal also has a first section 301 and a second section 302, wherein here the second section 302 has a higher gradient value than the first section 301. If in the first example the third signal crosses the first threshold value 303 in the area of the first section 301, minor changes 304 in the ionization current (or the signal value of the third signal) already lead to relatively large changes 305 in the crossing point in time. Here, such a minor change in the signal value of the third signal is illustrated in FIG. 3 by a corresponding change in the first threshold value for reasons of presentability. However, if in the second example, the third signal crosses the second threshold value 306 in the area of the second section 302, changes 307 in the ionization current (or the signal value of the third signal) with equal magnitude as in the first example result in markedly smaller changes 308 of the crossing point in time.

The fourth and fifth signals are, as explained above, preferably PWM signals. The magnitude of the ionization current here determines the pulse duration (or the duty factor or duty cycle) of the respective PWM signals. In the above described case, even minor changes in the flame resistance lead, in the first operating state, to a detectable change in the duty factor of the fourth signal and also major changes in the flame resistance can, in the second operating state, also be illustrated by changes in the duty factor of the fifth signal. This means that when the threshold values and gradient values are selected appropriately, the fourth signal provides the necessary resolution for the operating range of the burner, in which the flame has a large resistance (high-ohmic range), and the fifth signal provides the necessary resolution for the operating range of the burner in which the flame has a low resistance (low-ohmic range).

In block 250, the pulse width (changing over time) (i.e. width or duration of the square pulses) of the fourth signal is determined, and a sixth signal indicating this pulse width is generated or outputted. Correspondingly, the pulse width (changing over time) (i.e. width or duration of the square pulses) of the fifth signal is determined in block 255, and a seventh signal indicating this pulse width is generated or outputted.

On the basis of at least one of the fourth signal and fifth signal (or on the basis of at least one of the sixth signal and seventh signal) it is now possible to determine a value of an operating variable of the burner, e.g. ionization current, flame resistance, flame temperature, air ratio, burner output. This can be done by mathematical and/or logical linkage of the respective signals, i.e. e.g. by mathematical and/or logical linkage of the fourth and fifth signals or by mathematical and/or logical linkage of the sixth and seventh signals.

For example, one table each can be stored in a memory for the sixth and seventh signals, said table correlating values of the operating variable with respectively corresponding values of the pulse duration. On the basis of the operating variable values determined by means of these tables it is then possible to determine the value of the operating variable to be outputted.

A number of possibilities are conceivable in this connection. For example, the current operating range of the burner can be assessed from the two values determined by means of the tables. In accordance with this assessed operating range it is then possible to use one of the two values determined by means of the tables as the value to be outputted. When e.g. the assessed operating range is closer to the first operating range, the value determined on the basis of the sixth signal or otherwise the value determined on the basis of the seventh signal can be outputted. Furthermore, weighting factors for the two values determined by means of the tables can be derived on the basis of the assessed operating range, and a weighted sum of these values can be used as the value to be outputted. In general, the value of the operating variable to be outputted is determined by mathematical and/or logical linkage of the fourth and fifth signals or the sixth and seventh signals on the basis of the method according to the invention.

The value of the operating variable can be determined in an evaluation circuit (means for determining the operating variable of the burner).

The method according to the invention has been described above by means of concrete embodiments. Unless indicated separately, the present disclosure shall also extend to corresponding devices which carry out the method and which include apparatuses and means designed to carry out the corresponding method steps.

The invention has been specified by means of concrete embodiments without being limited to the concrete embodiments. In particular, it is possible to combine features of different embodiments and also use them in the other embodiments.

The invention claimed is:

1. A method for flame signal detection by means of an ionization electrode protruding into a combustion zone of a burner, comprising the steps:

detecting a first signal which is dependent on an ionization current flowing off the ionization electrode;

generating a second signal which has a predetermined periodic course;

generating a third signal by adding the first signal and the second signal;

comparing the third signal with a first threshold value;

comparing the third signal with a second threshold value different from the first threshold value;

generating a fourth signal on the basis of the comparison of the third signal with the first threshold value;

generating a fifth signal on the basis of the comparison of the third signal to the second threshold value; and determining an operating variable of the burner on the basis of at least one of the fourth signal and the fifth signal;

wherein the predetermined course of the second signal has a first section with a first gradient value and a second section with a second gradient value different from the first gradient value.

2. The method according to claim 1, wherein the first threshold value is selected in such a way that, for an ionization current occurring in a first operating state of the burner, the third signal crosses the first threshold value in each case at a first point in time within the period of the second signal, for which the second signal has a signal value which falls under the first section.

3. The method according to claim 1, wherein the second threshold value is selected in such a way that, for an ionization current occurring in a second operating state of the burner, the third signal crosses the second threshold value in each case at a second point in time within the period of the second signal, for which the second signal has a signal value which falls under the second section.

4. The method according to claim 1, wherein the operating variable of the burner is determined by mathematical and/or logical linkage of the fourth signal and the fifth signal or signals derived therefrom.

5. The method according to claim 1, comprising the further steps:

determining a first value of the operating variable of the burner on the basis of the fourth signal;

determining a second value of the operating variable of the burner on the basis of the fifth signal;

determining a third value of the operating variable of the burner on the basis of at least one of the first value and the second value.

6. The method according to claim 5, wherein the third value is determined by mathematical and/or logical linkage of the first value and the second value.

7. The method according to claim 1, wherein the first gradient value is less than the second gradient value, and the first operating state corresponds to a higher flame resistance than the second operating state.

8. A device for the flame signal detection by means of an ionization electrode protruding into combustion zone of a burner, said device comprising:

means for detecting a first signal which is dependent on an ionization current flowing off the ionization electrode;

means for generating a second signal which has a predetermined periodic course;

means for generating a third signal by adding the first signal and the second signal;

means for comparing the third signal with a first threshold value and for generating a fourth signal on the basis of the comparison of the third signal with the first threshold value;

means for comparing the third signal with a second threshold value different from the first threshold value and for generating a fifth signal on the basis of the comparison of the third signal with the second threshold value; and means for determining an operating variable of the burner on the basis of at least one of the fourth signal and the fifth signal;

wherein the predetermined course of the second signal has a first section with a first gradient value and a second section with a second gradient value which is different from the first gradient value.

9. A device for the flame signal detection by means of an ionization electrode protruding into combustion zone of a burner, said device comprising:

means for detecting a first signal which is dependent on an ionization current flowing off the ionization electrode;

means for generating a second signal which has a predetermined periodic course;

means for generating a third signal by adding the first signal and the second signal;

means for comparing the third signal with a first threshold value and for generating a fourth signal on the basis of the comparison of the third signal with the first threshold value;

means for comparing the third signal with a second threshold value different from the first threshold value and for generating a fifth signal on the basis of the comparison of the third signal with the second threshold value; and means for determining an operating variable of the burner on the basis of at least one of the fourth signal and the fifth signal;

wherein the first threshold value is selected in such a way that, for an ionization current occurring in a first operating state of the burner, the third signal crosses the first threshold value in each case at a first point in time within the period of the second signal, for which the second signal has a signal value which falls under the first section; and/or the second threshold value is selected in such a way that, for an ionization current occurring in a second operating state of the burner, the third signal crosses the second threshold value in each case at a second point of time within the period of the second signal, for which the second signal has a signal value which falls under the second section.

10. The device according to claim 8, wherein the means for determining the operating variable of the burner are designed to determine the operating variable of the burner by mathematical and/or logical linkage of the fourth signal and the fifth signal or signals derived therefrom.

11. The device according to claim 8, wherein the means for determining the operating variable of the burner are designed to determine a first value of the operating variable of the burner on the basis of the fourth signal, to determine a second value of the operating variable of the burner on the basis of the fifth signal and to determine a third value of the operating variable of the burner on the basis of at least one of the first value and the second value.

12. The device according to claim 11, wherein the means for determining the operating variable of the burner are designed to determine the third value by mathematical and/or logical linkage of the first value and the second value.

13. The device according to claim 8, wherein the first gradient value is less than the second gradient value and the first operating state corresponds to a higher flame resistance than the second operating state.

* * * * *